US007496311B2

(12) United States Patent
Ohno et al.

(10) Patent No.: US 7,496,311 B2
(45) Date of Patent: Feb. 24, 2009

(54) FIXING DEVICE WITH A MAGNETIC FLUX GENERATING SECTION AND A CONTROL SECTION

(75) Inventors: Yasuhiro Ohno, Toyokawa (JP); Tomihiko Masuda, Otsu (JP); Yuji Kamoda, Ibaraki (JP); Haruo Iwahashi, Hoi-gun (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 400 days.

(21) Appl. No.: 11/444,329

(22) Filed: Jun. 1, 2006

(65) Prior Publication Data

US 2007/0110467 A1 May 17, 2007

(30) Foreign Application Priority Data

Nov. 16, 2005 (JP) ..... 2005-331473

(51) Int. Cl.
*G03G 15/20* (2006.01)

(52) U.S. Cl. ..... 399/70; 399/328; 399/333

(58) Field of Classification Search ..... 399/69, 399/70, 328, 330, 331, 333
See application file for complete search history.

(56) References Cited

U.S. PATENT DOCUMENTS 7,171,148 B2 * 1/2007 Mitsuoka et al. ..... 399/328
7,212,761 B2 * 5/2007 Sone et al. ..... 399/69
7,299,002 B2 * 11/2007 Kagawa et al. ..... 399/328
2005/0067407 A1 3/2005 Tanino et al.

FOREIGN PATENT DOCUMENTS

| | | | |
|---|---|---|---|
| JP | 9-171312 | A | 6/1997 |
| JP | 10-301417 | | 11/1998 |
| JP | 11-311910 | | 11/1999 |
| JP | 2000-019876 | | 1/2000 |
| JP | 2000-214713 | A | 8/2000 |
| JP | 2002-055552 | A | 2/2002 |
| JP | 2003-098877 | | 4/2003 |
| JP | 2004-037888 | | 2/2004 |
| JP | 2005-017753 | | 1/2005 |
| JP | 2005-108602 | | 4/2005 |

OTHER PUBLICATIONS

English Language Translation of Japanese Office Action in Patent Application No. 2005-331473 dated May 27, 2008.
Office Action in JP 2005-331473, dated May 27, 2008.

* cited by examiner

*Primary Examiner*—William J Royer
(74) *Attorney, Agent, or Firm*—Buchanan Ingersoll & Rooney PC

(57) ABSTRACT

When a fixing roller 1 generates heat by a magnetic flux generating section 3 during a standby time, a control section 5 rotates the fixing roller 1. This prevents the fixing roller 1 from locally generating heat and being damaged. Moreover, the control section 5 rotates and heats a pressure roller 2 during the standby time, which makes it possible to keep the pressure roller 2 at a specified temperature and to reduce a time taken for a fixing device to recover from the standby state.

12 Claims, 4 Drawing Sheets

FIXING DEVICE WITH A MAGNETIC FLUX GENERATING SECTION AND A CONTROL SECTION

CROSS-REFERENCE TO RELATED APPLICATIONS

This application is based on application No. 2005-331473 filed in Japan, the entire content of which is hereby incorporated by reference.

BACKGROUND OF THE INVENTION

The present invention relates to a fixing device applied to image forming apparatuses such as copiers, laser printers and facsimiles.

Conventionally there is a fixing device composed of a fixing roller, a pressure roller for transporting a recording member with the fixing roller in the state of being in contact with the fixing roller, and a magnetic flux generating section placed outside the fixing roller for generating a magnetic flux to make the fixing roller generate heat (see JP 2000-214713 A).

However, in the conventional fixing device, when the magnetic flux generating section is operated while the fixing roller is in a stopped state during a standby time at which transportation of the recording member is not requested, there is a possibility that the fixing roller might locally generate heat and be damaged.

Moreover, during the standby time, the mere contact between the fixing roller and the pressure roller is not sufficient enough to successfully conduct heat from the fixing roller to the pressure roller, and therefore it becomes impossible to keep the pressure roller at a specified temperature during the standby time, as a result of which the fixing device needs a longer time to recover from the standby state.

SUMMARY OF THE INVENTION

An object of the present invention is to provide a fixing device capable of reducing a time taken for recovering from the standby state by keeping the pressure roller at a specified temperature while preventing failure of the fixing roller during the standby time.

In order to achieve the objects, the fixing device in this invention includes:

a rotatable fixing body;

a rotatable pressing body for transporting a recording member together with the fixing body in a state of being in contact with the fixing body;

a drive section for rotationally driving the fixing body or the pressing body;

a magnetic flux generating section for generating a magnetic flux to make the fixing body generate heat;

a heating body placed outside the pressing body for heating the pressing body; and a control section for controlling the drive section to rotate the fixing body and the pressing body in a state that the fixing body and the pressing body are in contact with each other and controlling the heating body to heat the pressing body during a standby time at which transportation of the recording member is not requested and when the magnetic flux generating section is making the fixing body generate heat.

According to the fixing device in the invention, the fixing body is rotated when the fixing body is generating heat by the magnetic flux generating section during the standby time at which transportation of the recording member is not requested, which prevents the fixing body from locally generating heat and being damaged. Moreover, the pressing body is heated while being rotated during the standby time at which transportation of the recording member is not requested, and this makes it possible to keep the pressing body at a specified temperature during the standby time and to reduce a time taken for the fixing device to recover from the standby state.

Moreover, in the fixing device of one embodiment, the fixing device includes a load change body for changing a load applied between the fixing body and the pressing body, wherein the control section controls the load change body so that the load applied between the fixing body and the pressing body during the standby time at which transportation of the recording member is not requested is smaller than the load during transportation of the recording member.

According to the fixing device in this aspect, the control section controls the load change body so that the load applied between the fixing body and the pressing body during the standby time at which transportation of the recording member is not requested is smaller than the load during transportation of the recording member, and therefore the fixing body and the pressing body are rotated during the standby time in the state that the load between the fixing body and the pressing body is low (light pressure contact state). Therefore, the load applied to the fixing body and the pressing body can be decreased, the elastic deformation amount and the wear amount of the fixing body and the pressing body decrease, and therefore the durability of the fixing body and the pressing body can be enhanced.

Moreover, in the fixing device of one embodiment, the heating body has:

a heat conducting section for coming into contact with the pressing body and conducting heat to the fixing body through the pressing body so as to reduce temperature variations in axial direction of the fixing body; and a heating section for heating the heat conducting section.

According to the fixing device in this aspect, the heating body has the heat conducting section for conducting heat to the fixing body through the pressing body so as to reduce temperature variations in the axial direction of the fixing body, and therefore when small-size recording members are passed in succession through the fixing body and the pressing body, high-temperature heat in a non-paper passing area in the fixing body moves to a low-temperature paper passing area in the fixing body through the heat conducting section. This makes it possible to prevent excessive temperature rise in the non-paper passing area in the fixing body and to make uniform the overall image quality of a large-size recording member when the large-size recording member is passed, as well as to prevent deformation and deterioration of the fixing body due to heat.

Moreover, in the fixing device of one embodiment, the fixing body has a sponge layer.

According to the fixing device in this aspect, the fixing body has a sponge layer, which can decrease the thermal capacity of the fixing body as a heat insulating member and can increase a width size of a nip section formed by mutual contact between the fixing body and the pressing body as an elastic member. This allows high-speed driving of the fixing device.

Moreover, in the fixing device of one embodiment, the pressing body has a sponge layer.

According to the fixing device in this aspect, the pressing body has a sponge layer, which can decrease the thermal capacity of the pressing body as a heat insulating member and can increase a width size of a nip section formed by the mutual contact between the fixing body and the pressing body as an elastic member. This allows high-speed driving of the fixing device.

Moreover, in the fixing device of one embodiment, the magnetic flux generating section is placed outside the fixing body.

According to the fixing device in this aspect, the magnetic flux generating section is placed outside the fixing body, which facilitates placement of the magnetic flux generating section and makes the fixing body having the sponge layer appropriately generate heat.

Moreover, in the fixing device of one embodiment, when the recording member passes between the fixing body and the pressing body, the control section brings the heating body into contact with the pressing body in a state that heating of the heating body is turned off.

According to the fixing device in this aspect, when the recording member passes between the fixing body and the pressing body, the control section brings the heating body into contact with the pressing body in the state that heating of the heating body is turned off, and therefore high-temperature heat in a non-paper passing area in the fixing body moves to a low-temperature paper passing area in the fixing body through the pressing body and the unheated heating body, which makes it possible to achieve an effect of preventing or alleviating temperature rise in the non-paper passing area.

Moreover, the fixing device in this invention includes:

a rotatable fixing roller having a sponge layer, an electromagnetic induction heat generating layer and a release layer laminated in sequence around a support layer;

a pressure roller placed in contact with the fixing roller for transporting a recording member together with the fixing roller;

a drive section for rotationally driving the fixing roller or the pressure roller;

a magnetic flux generating section for generating a magnetic flux to make the fixing roller generate heat;

a heat conducting roller placed in contact with the pressure roller;

a heating section for heating the heat conducting roller; and a control section which operates the drive section, the magnetic flux generating section and the heating section during a standby time at which transportation of the recording member is not requested, and which operates the drive section and the magnetic flux generating section but does not operate the heating section during a paper passing time at which transportation of the recording member is requested.

According to the fixing device in this invention, the control section operates the drive section, the magnetic flux generating section and the heating section during a standby time at which transportation of the recording member is not requested, and this makes it possible to keep the pressure roller at a specified temperature during the standby time so as to reduce time taken for the fixing device to recover from the standby state. Moreover, the control section operates the drive section and the magnetic flux generating section but does not operate the heating section during a paper passing time at which transportation of the recording member is requested, and therefore high-temperature heat in a non-paper passing area in the fixing roller moves to a low-temperature paper passing area in the fixing roller through the pressure roller and the unheated heating body, which makes it possible to achieve an effect of preventing or alleviating temperature rise in the non-paper passing area.

Moreover, in the fixing device of one embodiment, the fixing device includes:

a first temperature detection section for detecting a surface temperature of the fixing roller; and a second temperature detection section for detecting a surface temperature of the pressure roller, wherein the control section controls the magnetic flux generating section and the heating section based on outputs from the first temperature detection section and the second temperature detection section so that the surface temperature of the fixing roller and the surface temperature of the pressure roller are each maintained to be specified temperatures during the standby time.

According to the fixing device in this aspect, the control section controls the magnetic flux generating section and the heating section based on outputs from the first temperature detection section and the second temperature detection section so that the surface temperature of the fixing roller and the surface temperature of the pressure roller are each maintained to be specified temperatures during the standby time, which makes it possible to reliably reduce a time taken for the fixing device to recover from the standby state.

Moreover, in the fixing device of one embodiment, the fixing roller has an elastic layer between the electromagnetic induction heat generating layer and the release layer.

According to the fixing device in this aspect, the fixing roller has the elastic layer between the electromagnetic induction heat generating layer and the release layer, which enhances adhesion between the recording member and the surface of the fixing roller and makes the fixing device suitable for color images.

Moreover, in the fixing device of one embodiment, an axial length of the heat conducting roller is longer than an axial length of the pressure roller.

According to the fixing device in this aspect, the axial length of the heat conducting roller is longer than the axial length of the pressure roller, so that the heat conducting roller comes into contact with the entire axial region of the pressure roller. This makes it possible to reliably maintain the pressure roller at a specified temperature during the standby time. Moreover, it becomes possible to reliably prevent temperature rise in the non-paper passing region in the fixing roller.

Moreover, in the fixing device of one embodiment, the fixing device includes a load change body for changing a load applied between the fixing roller and the pressure roller, wherein the control section controls the load change body so that the load applied between the fixing roller and the pressure roller during the standby time is smaller than the load during paper passing time.

According to the fixing device in this aspect, the control section controls the load change body so that the load applied between the fixing roller and the pressure roller during the standby time is smaller than the load during paper passing time, and therefore the fixing roller and the pressure roller are rotated during the standby time in the state that the load between the fixing roller and the pressure roller is light (light pressure contact state). Consequently, the load applied to the fixing roller and the pressure roller can be decreased, by which the elastic deformation amount and the wear amount of the fixing roller and the pressure roller decrease and therefore the durability of the fixing roller and the pressure roller can be enhanced.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will be described hereinbelow in detail in conjunction with the embodiment with reference to the accompanying drawings.

Figure 1:
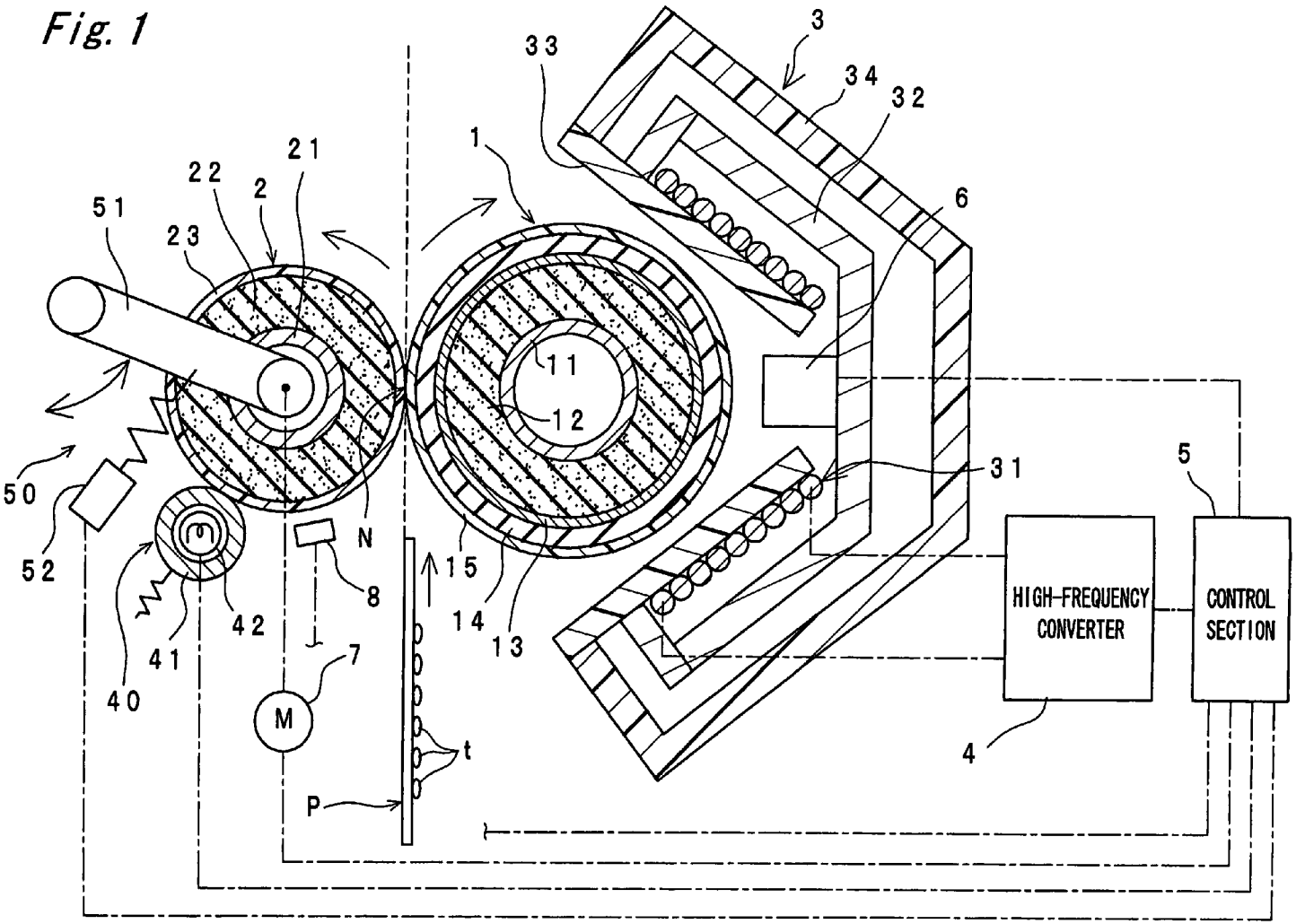
FIG. 1 is a cross sectional structure view showing a fixing device in one embodiment of the present invention.

FIG. 1 is a cross sectional structure view showing a fixing device in one embodiment of the present invention. The fixing device includes a fixing roller 1 as a rotatable fixing body, a pressure roller 2 as a pressing body coming in pressure contact with the fixing roller 1, and a magnetic flux generating section 3 placed outside the fixing roller 1 for generating a magnetic flux to make the fixing roller 1 generate heat.

After the fixing roller 1 is made to generate heat by a magnetic flux from the magnetic flux generating section 3, a recording member P having an unfixed toner t attached thereto is passed through a nip section N formed from a mutual contact face between the fixing roller 1 and the pressure roller 2, and while the recording member P is transported by the nip section N, the unfixed toner t is melted and fixed (heated and fixed) onto the recording member P.

It is to be noted that the fixing device constitutes an image forming apparatus such as copiers, laser printers and facsimiles together with an (unshown) imaging means for attaching the unfixed toner t onto the recording member P to form an image.

The recording member P is exemplified by sheets such as paper sheets and OHP sheets, and the toner t is made of materials having thermal meltability such as resins, magnetic materials and colorants The fixing roller 1 and the pressure roller 2 are placed in such a way as to parallely face each other, and both end sides of each roller are rotatably supported by an unshown bearing member.

The pressure roller 2 is equipped with a load change body 50 for changing a load applied between the fixing roller 1 and the pressure roller 2. The pressure roller 2 is biased toward the fixing roller 1 by the load change body 50 and is brought into pressure contact with the outer surface of the fixing roller 1 with a specified pressure. The mutual contact between the fixing roller 1 and the pressure roller 2 forms the nip section N.

The pressure roller 2 is rotationally driven counterclockwise as shown by an arrow at a specified peripheral velocity by a motor 7 as a drive section. The fixing roller 1 rotates following after the rotation of the pressure roller 2 by friction force attained by friction with the pressure roller 2 in the nip section N.

A heating body 40 for heating the pressure roller 2 is placed outside the pressure roller 2. The heating body 40 has a heat conducting roller 41 as a heat conduction section for coming into contact with the pressure roller 2 to conduct heat to the pressure roller 2, and a heater 42 as a heating section placed inside the heat conducting roller 41 for heating the heat conducting roller 41.

The fixing roller 1 has a support layer 11, a sponge layer 12, an electromagnetic induction heat generating layer 13, an elastic layer 14 and a release layer 15 placed in sequence from the inside toward the outside in the radial direction. The hardness of the fixing roller 1 is, for example, 30 to 90 degrees in Asker-C scale. It is to be noted that in this embodiment, the fixing roller 1 has the elastic layer 14 for supporting color images, though the fixing roller 1 has only to have at least the support layer 11, the sponge layer 12, the electromagnetic induction heat generating layer 13 and the release layer 15.

As the support layer 11, an aluminum mandrel cylinder with an outer diameter of 40 mm and a thickness of 3 mm is used for example. The material of the support layer 11 may be a heat-resistant molded pipe made of, for example, iron or PPS (polyphenylene sulfide) as long as the strength of the material can be ensured. However, in order to prevent the mandrel from generating heat, nonmagnetic materials which are less affected by electromagnetic induction heating should preferably be used.

The sponge layer 12, which is for insulating and retaining heat generated by the electromagnetic induction heat generating layer 13, is made of sponges (heat insulating structures) made from rubber materials and resin materials having heat resistance and elasticity. Thus, by making the sponge layer 12 with sponges (heat insulating structures) made from rubber materials and resin materials having heat resistance and elasticity, it becomes possible to reliably insulate and retain the electromagnetic induction heat generating layer 13 as well as to increase a width size of the nip section N by allowing deflection of the electromagnetic induction heat generating layer 13, and further it becomes possible to enhance sheet discharge performance and recording member separating performance by making the hardness of the fixing roller 1 lower than that of the pressure roller 2. In the case where the sponge layer 12 is made of a silicon sponge material for example, its thickness is set at 2 mm to 10 mm, preferably 3 mm to 7 mm and its hardness is set at 20 to 60 degrees, preferably 30 to 50 degrees according to an Asker rubber hardness meter.

The electromagnetic induction heat generating layer 13 is, for example, an endless electroformed nickel belt layer with a thickness of 10 to 100 μm and preferably 20 to 50 μm. It is to be noted that as the material of the electromagnetic induction heat generating layer 13, those having a relatively high magnetic permeability μ and an appropriate resistivity ρ such as magnetic materials (magnetic metals) including magnetic stainless steels may be used. Even nonmagnetic materials, if having conductivity, such as metals may be used by, for example, forming them into thin films. Moreover, the electromagnetic induction heat generating layer 13 may be structured such that particles which generate heat are dispersed over resin since the electromagnetic induction heat generating layer 13 made of resin-based materials can further enhance the separating performance of the recording member P. The electromagnetic induction heat generating layer 13 is bonded to the sponge layer 12.

In the electromagnetic induction heat generating layer 13, an eddy current is generated by a magnetic flux from the magnetic flux generating section 3 and the electromagnetic induction heat generating layer 13 generates Joule heat, by which the fixing roller 1 is heated. This heating is referred to as electromagnetic induction heating.

The elastic layer 14, which is made of a rubber material or a resin material having heat resistance and elasticity, promotes adhesion between the recording member P and the surface of the fixing roller 1. As the elastic layer 14, heat-resistant elastomer such as silicon rubber and fluorocarbon rubber which can withstand use at fixing temperatures is used for example. It is possible to mix various fillers into the elastic layer 14 for the purpose of enhancing thermal conductivity, reinforcement or the like. While examples of thermally conductive particles include diamond, silver, copper, aluminum, marble and glass, practical examples thereof include silica, alumina, magnesium oxide, boron nitride and beryllium oxide.

The thickness of the elastic layer 14 should preferably be, for example, 10 μm to 800 μm and more preferably be 100 μm to 300 μm. If the thickness of the elastic layer 14 is less than 10 μm, it is difficult to attain elasticity in the thickness direction, whereas if the thickness of the elastic layer 14 exceeds 800 μm, heat generated in the electromagnetic induction heat generating layer 13 cannot easily reach the outer peripheral face of the fixing roller 1, which causes a tendency for the thermal efficiency to deteriorate.

The hardness of the elastic layer 14 should be 1 to 80 degrees and preferably 5 to 30 degrees in JIS hardness scale, because it becomes possible to prevent failure in the fixing property of unfixed toner t while preventing degradation in the strength of the elastic layer 14 and adhesion failure. In this case, the elastic layer 14 should preferably be made of silicon rubber, and specific examples of the silicon rubber include one-component, two-component or three or more-component silicon rubbers, LTV-type, RTV-type or HTV-type silicon rubbers, and condensation-type or addition-type silicon rubbers. It is to be noted that in this embodiment, the elastic layer 14 is a silicon rubber with a JIS hardness of 10 degree and a thickness of 200 μm.

The release layer 15, which is for enhancing the releasing property of the surface of the fixing roller 1, withstands use at fixing temperatures and has the releasing property for toner. As the release layer 15, silicon rubber, fluorocarbon rubber and fluorocarbon resin such as PFA, PTFE, FEP and PFEP are used for example. The thickness of the release layer 15 is preferably 5 μm to 100 μm and more preferably 10 μm to 50 μm. Moreover, adhesion processing with use of primers and the like may be performed in order to enhance interlayer adhesion force. It is to be noted that according to need, the release layer 15 may contain conductive materials, abrasion-resistant materials and good thermal conductive materials as fillers.

The pressure roller 2 has a support layer 21, a sponge layer 22 and a release layer 23 placed in sequence from the inside toward the outside in the radial direction. The support layer 21 is, for example, an aluminum mandrel with an outer diameter of 20 mm and a thickness of 3 mm. The sponge layer 22 is, for example, a silicon sponge rubber of 3 to 10 mm formed by foaming silicon rubber. The release layer 23 is, for example, fluorocarbon resin such as PTFE and PFA with a thickness of 10 to 50 μm.

The material of the support layer 21 may be a heat-resistant molded pipe made of, for example, iron or PPS (polyphenylene sulfide) as long as the strength can be ensured. However, in order to prevent the mandrel from generating heat, nonmagnetic materials which are less affected by electromagnetic induction heating should preferably be used.

The pressure roller 2 is pressed toward the fixing roller 1 with a load of 300 to 500N, and in this case, the width size of the nip section N (the size in the transportation direction of the recording member P) is approx. 5 to 15 mm. It is naturally possible to change the width size of the nip section N by changing the load.

The thermal conductivity of the sponge layer 22 in the pressure roller 2 should preferably be 0.15 W/(m·K) or less. Limiting the thermal conductivity in such a range makes it possible to keep down an amount of heat of the fixing roller 1 removed by the pressure roller 2. Consequently, the thermal conductivity can be enhanced and quick start of the fixing device can be achieved.

The magnetic flux generating section 3 faces the fixing roller 1 in the state of extending along the longitudinal direction of the fixing roller 1. The magnetic flux generating section 3 has a bobbin 33 placed along the outer face of the fixing roller 1, a circular coil 31 placed on the outer face of the bobbin 33, a magnetic core 32 placed on the opposite side of the fixing roller 1 with respect to the coil 31 so as to cover the coil 31, and a cover member 34 mounted on the bobbin 33 so as to cover the coil 31 and the magnetic core 32.

The bobbin 33 is formed to have a cuplike (trapezoidal) transverse section with the fixing roller 1 side being expanded and opened. The bobbin 33 covers almost half the transverse section of the fixing roller 1. The bobbin 33 has an aperture facing the fixing roller 1 on its bottom section.

The coil 31 has such a structure that a conductive wire is wound along the outer face of the bobbin 33 so that the axial direction of the fixing roller 1 becomes longer and its traverse section is trapezoidal. More particularly, the coil 31 is placed along the outer face of the fixing roller 1.

The magnetic core 32, which is a long member having a length size roughly corresponding to an axial size of the fixing roller 1, has a specified clearance from the bobbin 33, and the coil 31 is placed in this clearance.

As the magnetic core 32, materials having high magnetic permeability and low loss are used. The magnetic core 32 is used to increase the efficiency of magnetic circuits and to shield magnetism. As the material of the magnetic core 32, ferrite cores are usually used, though in the case of using alloys such as permalloys, the magnetic core 32 may have a laminated structure since an eddy current loss inside the magnetic core 32 is increased by radio frequencies. It is to be noted that using resin materials with magnetic powders dispersed therethrough allows free setting of its shape though magnetic permeability becomes relatively low.

An (unshown) protrusion protruding toward the fixing roller 1 may be provided in the central section of the magnetic core 32 for enhancing the heat generation efficiency of the fixing roller 1. It is to be noted that the protrusion may be removed from the magnetic circuit section of the coil 31 and the magnetic core 32 if there is a means to provide sufficient magnetic shielding.

A high-frequency converter 4 is connected to the coil 31 to supply, for example 100 to 2000 W radio frequency power. Accordingly, used as the coil 31 is a Litz wire formed by bunching several dozen to several hundred thin wires, and the Litz wire is coated with heat-resistant resin in consideration of heat conducted to the coil 31.

A first temperature detection section 6 for detecting the surface temperature of the fixing roller 1 is placed outside the fixing roller 1 and inside the magnetic core 32 in such a way as to align with a central hole section of the coil 31. The first temperature detection section 6 is mounted on the magnetic core 32 in its central position in the axial direction of the fixing roller 1. The first temperature detection section 6, which is a noncontact-type thermistor for example, is placed in a position away from the surface of the fixing roller 1.

The first temperature detection section 6 is connected to a control section 5, and the control section 5 controls the high-frequency converter 4 based on a surface temperature detection signal about the fixing roller 1 from the first temperature detection section 6 for increasing or decreasing power supply in the high-frequency converter 4 to the coil 31 so as to perform automatic control to keep the surface temperature of the fixing roller 1 to be a specified constant temperature. More particularly, the control section 5 makes the fixing roller 1 generate heat by the magnetic flux generating section 3.

Description is given of the action of the magnetic flux generating section 3. An alternating current of, for example, 10 to 100 kHz is applied to the coil 31 by the high-frequency converter 4. The magnetic flux induced by the alternating current passes through the inside of the magnetic core 32 without leaking to the outside, and then in the vicinity of both the sides of the coil 31, it leaks to the outside of the magnetic core 32 and penetrates the electromagnetic induction heat generating layer 13 of the fixing roller 1, which causes an eddy current to flow through the electromagnetic induction heat generating layer 13 and makes the electromagnetic induction heat generating layer 13 itself generate Joule heat. The heat generated in the electromagnetic induction heat generating layer 13 puts the fixing roller 1 in a heated state.

A second temperature detection section 8 for detecting the surface temperature of the pressure roller 2 is electrically connected to the control section 5. The second temperature detection section 8 is, for example, a noncontact-type thermistor.

The load change body 50 is composed of a link section 51 and an oscillation section 52 for oscillating the link section 51. One end of the link section 51 is linked to a shaft of the pressure roller 2, while the other end of the link section 51 is linked to an unshown casing. The oscillation section 52 has, for example, a solenoid and a spring for oscillating the link section 51 in an arrow direction centering around the other end of the link section 51.

The oscillation section 52 is electrically connected to the control section 5, and a load applied between the fixing roller 1 and the pressure roller 2 (i.e., pressure in the nip section N) is controlled to be changed by the control section 5.

The load change body 50 can change the pressure in the nip section N at least in two levels, that is, for the time of transporting and fixing the recording member P in the nip section N (hereinbelow referred to as transportation time) and for the time at which transportation of the recording member P is not requested (hereinbelow referred to as standby time).

The control section 5 controls the load change body 50 so that a load applied between the fixing roller 1 and the pressure roller 2 during the standby time at which transportation of the recording member P is not requested is smaller than the load during transportation of the recording member P.

More specifically, during transportation of the recording member, pressure of 0.08 to 0.22 Mpa is applied by a load of 400 to 600N between the fixing roller 1 and the pressure roller 2 to perform a fixing operation. The width size of the nip section N in this case is approx. 5 to 15 mm, though the width size of the nip section N can be adjusted by changing the load as appropriate in conformity with various conditions such as transportation speeds, toner types and toner adhesion amounts. More particularly, during transportation of the recording member P, the pressure roller 2 is in strong pressure contact with the fixing roller 1.

During standby time, pressure of 0.02 to 0.05 Mpa is applied by a load of 50 to 100N between the fixing roller 1 and the pressure roller 2, which allows the pressure to be reduced to ⅓ to ⅕ of the pressure applied during transportation of the recording member P. The width size of the nip section N in this case is approx. 1 to 4 mm, and therefore an area of the nip section N decreases. More particularly, during the standby time, the pressure roller 2 is in light pressure contact with the fixing roller 1.

The heat conducting roller 41 of the heating body 40 is biased toward the pressure roller 2 by a spring and comes into contact with the outer face of the pressure roller 2. The axial length of the heat conducting roller 41 is longer than the axial length of the pressure roller 2, and so the heat conducting roller 41 comes into contact with the entire axial region of the pressure roller 2. The heat conducting roller 41 rotates following after the pressure roller 2. It is to be noted that mechanisms other than the spring may be used to bring the heat conducting roller 41 into pressure contact with the pressure roller 2.

Examples of the heater 42 of the heating body 40 include a lamp heater. It is to be noted that the heater 42 may be a resistance heating element instead of the lamp heater. The heater 42 heats the heat conducting roller 41 and the heat conducting roller 41 heats the pressure roller 2.

Herein, increasing pressure contact force exerted by the heat conducting roller 41 upon the pressure roller 2 increases the width size of the nip section formed by the contact between the heat conducting roller 41 and the pressure roller 2 and increases the amount of heat transmitted from the heat conducting roller 41 to the pressure roller 2, which is advantageous in terms of maintaining the temperature of the pressure roller 2. Excessive increase of the load exerted by the heat conducting roller 41 upon the pressure roller 2 for increasing the width size of the nip section promotes deterioration of the pressure roller 2 and causes shorter life.

Accordingly, the load exerted by the heat conducting roller 41 upon the pressure roller 2 should preferably be 30 to 200N (more preferably be 50 to 100N). Moreover, a pressure value in the nip section in this case should preferably be 0.01 to 0.15 MPa (more preferably be 0.03 to 0.1 MPa), while the width size of the nip section should preferably be 2 to 5 mm (more preferably be 3 to 4 mm). This makes it possible to achieve sufficient movement of heat from the heat conducting roller 41 to the pressure roller 2 while preventing deterioration of the pressure roller 2.

While the thermal conductivity of the heat conducting roller 41 is higher the better, it should at least be 12 W/(m·k) or more, preferably be 100 W/(m·k) or more, and more preferably be 200 W/(m·k) or more. The material of the heat conducting roller 41 should preferably be those having high strength such as aluminum, iron and stainless steel, and among these, the aluminum having high thermal conductivity is particularly preferable.

When the magnetic flux generating section 3 is making the fixing roller 1 generate heat during the standby time at which transportation of the recording member P is not requested, the control section 5 makes the motor 7 rotate the fixing roller 1 and the pressure roller 2 in the state that the fixing roller 1 and the pressure roller 2 are in contact with each other, and the control section 5 makes the heating body 40 heat the pressure roller 2.

Figure 2:
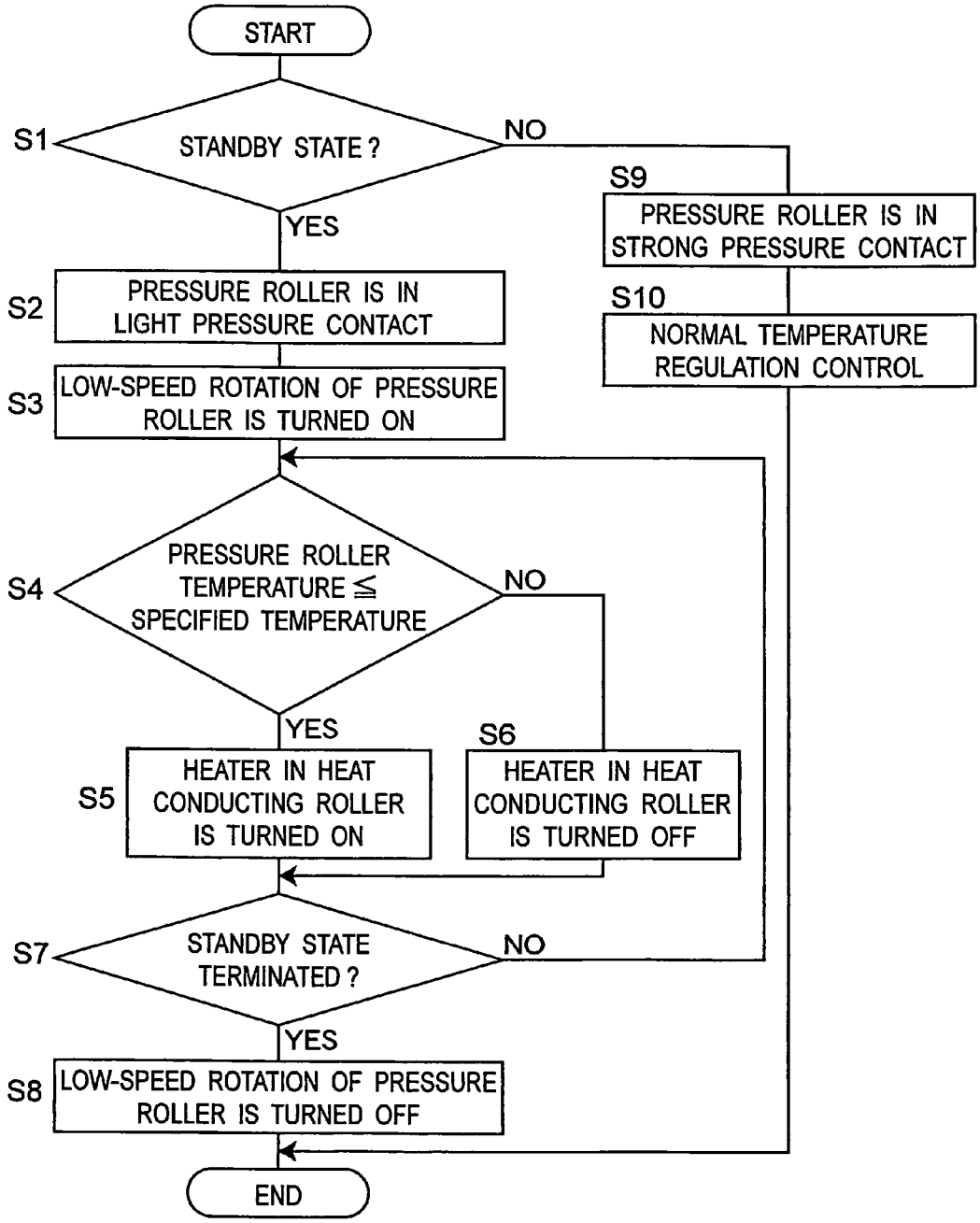
FIG. 2 is a flowchart showing control over a heating body and a load change body by a control section.

Next, FIG. 2 shows a flowchart showing control over the heating body 40 and the load change body 50 by the control section 5.

First, the control section 5 determines whether or not the fixing device is in a standby state (step S1). If it is determined by the control section 5 that the fixing device is in the standby state, then the control section 5 controls the load change body 50 so as to reduce the pressure contact force exerted by the pressure roller 2 upon the fixing roller 1 and to put the pressure roller 2 in a light pressure contact state (step S2). Further, the pressure roller 2 is rotated at low speed by the control section 5 (step S3) so as to further reduce the load exerted upon the fixing roller 1 and the pressure roller 2 as well as to prevent heat from being locally concentrated on the fixing roller 1.

Next, the temperature of the pressure roller 2 is detected by the second temperature detection section 8, and the control section 5 determines whether or not the temperature detected by the second temperature detection section 8 is not more than a specified temperature (step S4).

If it is determined by the control section 5 that the temperature of the pressure roller 2 is not more than a specified temperature, the control section 5 turns on the heater 42 in the heat conducting roller 41 (step S5) to heat the pressure roller 2 through the heat conducting roller 41 so as to maintain the temperature of the pressure roller 2. If it is determined by the control section 5 that the temperature of the pressure roller 2 is more than a specified temperature, then the control section 5 turns off the heater 42 in the heat conducting roller 41 (step S6).

Then, the control section 5 determines whether or not the fixing device recovers from the standby state (step S7). If it is determined by the control section 5 that the fixing device has not yet recovered from the standby state, then step S4 to step S6 are repeatedly executed. If it is determined by the control section 5 that the fixing device has recovered from the standby state, then the control section 5 stops the low speed rotation of the pressure roller 2 (step S8), and this routine is terminated.

It is to be noted that if the control section 5 determines in step S1 that the fixing device is not in the standby state, then the control section 5 controls the load change body 50 to increase the pressure contact force exerted by the pressure roller 2 upon the fixing roller 1 and put the pressure roller 2 in a strong pressure contact state (step S9). Further, normal temperature regulation control is performed on the fixing roller 1 and the pressure roller 2 by the control section 5 (step S10), and the recording member P is fixed while being transported in the nip section N.

By such control, even in the state that the heat transmission amount from the fixing roller 1 is small, it becomes possible to keep the temperature of the pressure roller 2 to be a specified temperature or more and to hasten the recovery of the fixing device from the standby state.

Figure 3:
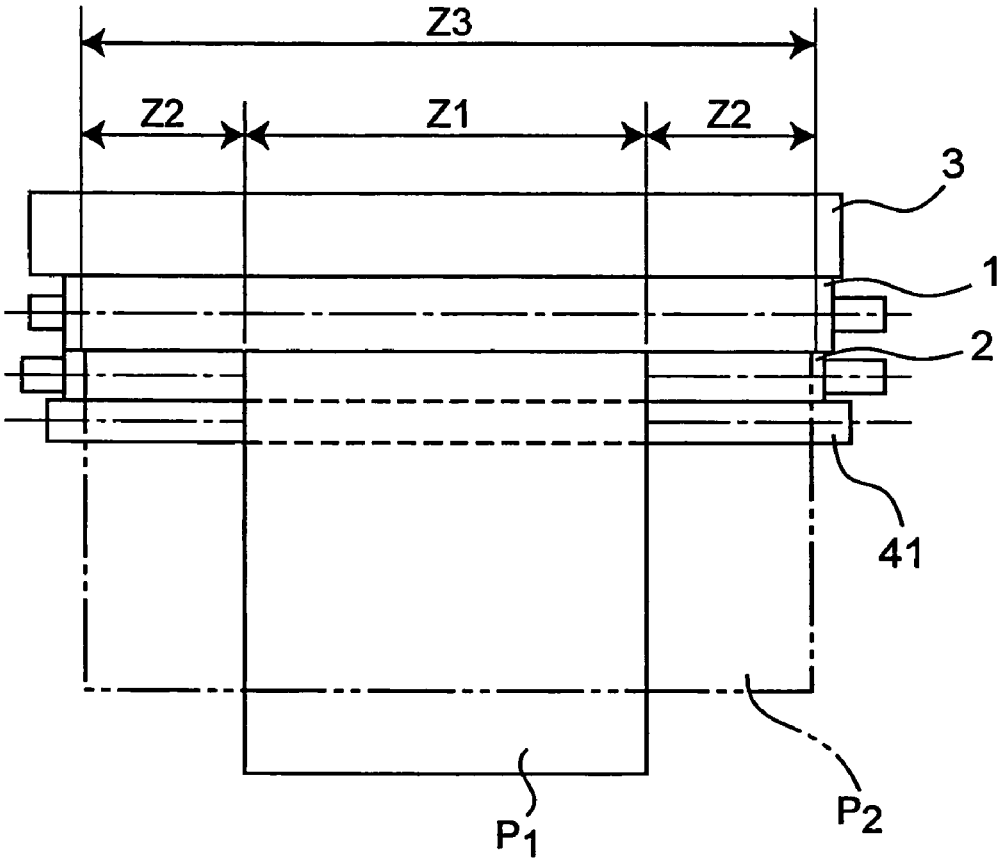
FIG. 3 is a simplified plane view showing the fixing device in the state that a small-size recording member is passing.

Next, FIG. 3 shows the state that a small-size recording member $P_1$ is passed through the fixing device, and with reference to FIG. 3, description will be given of the case where the small-size recording member $P_1$ is passed in succession through the fixing device and fixing of a large amount of the recording members $P_1$ is performed.

In this case, in a section of the surface of the fixing roller 1 with which the recording member $P_1$ comes into contact (hereinbelow referred to as a paper passing region Z1), heat of the fixing roller 1 is transmitted to the recording member $P_1$. In a portion that is the section of the fixing roller 1 at which heat is generated by the magnetic flux generating section 3 (hereinbelow referred to as a heating region Z3) and that is the section of the surface of the fixing roller 1 with which the recording member $P_1$ does not come into contact (hereinbelow referred to as a non-paper passing region Z2), there is nothing to which the heat of the fixing roller 1 is imparted and therefore heat is accumulated in the fixing roller 1.

Consequently, a large temperature difference is generated between the paper passing region Z1 and the non-paper passing region Z2. Normally, the paper passing region Z1 is maintained at a specified temperature, which causes excessive temperature rise in the non-paper passing region Z2.

Thus, the excessive temperature rise in the non-paper passing region Z2 deteriorates the material of the fixing roller 1 by heat and shortens the life of the fixing roller 1. Moreover, when a large size recording member $P_2$ shown by a virtual line is passed after the small size recording member $P_1$ is passed in succession, the end section and the central section of the recording member $P_2$ have different gloss. Moreover, in the case of using silicon rubber for the elastic layer 14 of the fixing roller 1 (see FIG. 1), the temperature of the non-paper passing region Z2 exceeds the upper limit of the heat-resisting temperature of the silicon rubber.

However, in this fixing device, the heat conducting roller 41 conducts heat to the fixing roller 1 through the pressure roller 2 in such a way as to reduce temperature variations in the rotational shaft direction of the fixing roller 1. More particularly, high-temperature heat in the non-paper passing region Z2 moves to the low-temperature paper passing region Z1 through the heat conducting roller 41.

Therefore, it becomes possible to prevent or alleviate excessive temperature rise in the non-paper passing region Z2 and solve the problems attributed to the temperature rise in the non-paper passing region Z2.

Herein, by setting the thermal capacity of the heat conducting roller 41 and the width size of the nip section formed from the heat conducting roller 41 and the pressure roller 2 at appropriate values, the temperature rise in the non-paper passing region Z2 can be prevented further.

For example, the thermal capacity of the heat conducting roller 41 per unit length is 200 to 1000 J (m·k), preferably 250 to 500 J (m·k). Moreover, in the case of using an aluminum roller with a diameter of 15 to 30 mm as the heat conducting roller 41, the thickness of the roller should preferably be 2 to 5 mm. Moreover, in the case of using an iron or stainless steel roller with a diameter of 15 to 30 mm as the heat conducting roller 41, the thickness of the roller should preferably be 1 to 3 mm.

Figure 4:
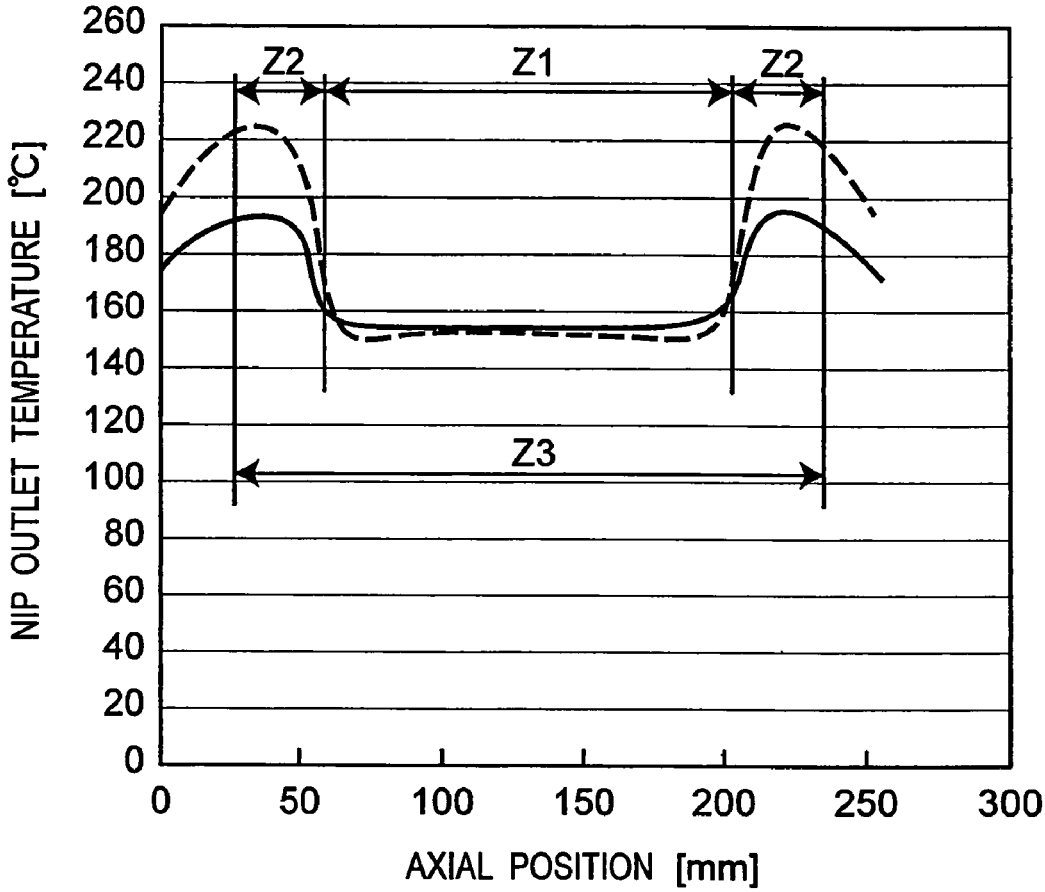
FIG. 4 is a graph view showing temperature distribution of a fixing roller with a heat conducting roller in contact with or out of contact with a pressure roller.

Next, FIG. 4 shows a graph view showing temperature distribution of the fixing roller 1 with the heat conducting roller 41 in contact with or out of contact with the pressure roller 2.

More specifically, FIG. 4 shows temperature distribution in the paper passing region Z1 and the non-paper passing region Z2 in the fixing roller 1 when the temperature of the paper passing region Z1 in the fixing roller 1 is 170° C. and 100 small size recording members $P_1$ are passed in succession.

Herein, the horizontal axis represents an axial position of the fixing roller 1 provided that one end section of the fixing roller 1 is 0 mm. The vertical axis represents a nip outlet temperature, more specifically, a temperature of the fixing roller 1 on the downstream side of the nip section N (see FIG. 1) in the transportation direction of the recording member P. It is to be noted that the allowable temperature on the durability of the fixing roller 1 is 220° C.

When the heat conducting roller 41 is brought into contact with the pressure roller 2 in the state that the heater 42 of the heat conducting roller 41 is turned off, the temperature of the non-paper passing region Z2 becomes smaller than 220° C. as shown by a solid line in FIG. 4. Therefore, the temperature of the non-paper passing region Z2 is smaller than the allowable temperature of the fixing roller 1, and this makes it possible to prevent denaturalization and deterioration of the fixing roller 1 by heat.

In the case where the heat conducting roller 41 is out of contact with the pressure roller 2, the temperature of the non-paper passing region Z2 exceeds 220° C. as shown by a broken line in FIG. 4, Therefore, the temperature of the non-paper passing region Z2 is larger than the allowable temperature of the fixing roller 1, and this causes the fixing roller 1 to suffer denaturalization and deterioration by heat.

Thus, the heat conducting roller 41 is brought into contact with the pressure roller 2 by the control section 5 during paper passing time in the state that the heater 42 of the heat conducting roller 41 is turned off, by which high-temperature heat in the non-paper passing region Z2 in the fixing roller 1 moves to the low-temperature paper passing region Z1 in the fixing roller 1 through the pressure roller 2 and the heat conducting roller 41 not heated by the heater 42, and this makes it possible to achieve an effect of preventing or alleviating temperature rise in the non-paper passing area.

In other words, the control section 5 operates the motor 7, the magnetic flux generating section 3 and the heater 42 during the standby time at which transportation of the recording member P is not requested, while the control section 5 operates the motor 7 and the magnetic flux generating section 3 but does not operate the heater 42 during the paper passing time at which transportation of the recording member P is requested.

More particularly, the control section 5 controls the magnetic flux generating section 3 and the heater 42 based on outputs from the first temperature detection section 6 and the second temperature detection section 8 so that the surface temperature of the fixing roller 1 and the surface temperature of the pressure roller 2 are each maintained to be specified temperatures during the standby time.

According to the above-structured fixing device, the fixing roller 1 is rotated when the fixing roller 1 is generating heat by the magnetic flux generating section 3 during the standby time at which transportation of the recording member P is not requested, which prevents the fixing roller 1 from locally generating heat and being damaged. Moreover, the pressure roller 2 is heated while being rotated during the standby time at which transportation of the recording member P is not requested, and this makes it possible to keep the pressure roller 2 at a specified temperature during the standby time and to reduce a time taken for the fixing device to recover from the standby state of the fixing device.

Moreover, the control section 5 controls the load change body 50 so that the load applied between the fixing roller 1 and the pressure roller 2 during the standby time at which transportation of the recording member P is not requested is smaller than the load during transportation of the recording member P, and therefore the fixing roller 1 and the pressure roller 2 are rotated during the standby time in the state that the load between the fixing roller 1 and the pressure roller 2 is light (light pressure contact state). Consequently, the load applied to the fixing roller 1 and the pressure roller 2 can be decreased, by which the elastic deformation amount and the wear amount of the fixing roller 1 and the pressure roller 2 decreases and therefore the durability of the fixing roller 1 and the pressure roller 2 can be enhanced.

Herein, as a comparative example, when the fixing roller 1 is made to generate heat while being rotated during the standby time, the fixing roller 1 and the pressure roller 2 are put in the usual strong pressure contact state. As a result, the load upon the fixing roller 1 increases, which increases the elastic deformation amount and the wear amount of the fixing roller 1 and the pressure roller 2 and considerably deteriorates the durability.

If the fixing roller 1 and the pressure roller 2 are rotated in the light pressure contact state in order to decrease the load upon the fixing roller 1, an area of the nip section N formed in between the fixing roller 1 and the pressure roller 2 decreases, which disturbs sufficient heat transmission to the pressure roller 2 and disables the pressure roller 2 from being kept at a specified temperature. If the temperature of the pressure roller 2 is below a specified value, fixing by the fixing roller 1 and the pressure roller 2 becomes insufficient, which may cause image deterioration such as low-temperature offset and lowered glossiness.

Accordingly, in the comparative example, it is necessary to stop paper passing so as to increase the temperature of the pressure roller 2 till the temperature of the pressure roller 2 fully rises from the standby state, and this brings about a drawback that it takes time to recover from the standby time.

In the present invention, the temperature of the pressure roller 2 is maintained while the load between the fixing roller 1 and the pressure roller 2 is light, and therefore it becomes possible to enhance the durability of the fixing roller 1 and the pressure roller 2.

Moreover, according to the above-structured fixing device, the heating body 40 has the heat conducting roller 41 for conducting heat to the fixing roller 1 through the pressure roller 2 so as to reduce temperature variations in the rotational shaft direction of the fixing roller 1, and therefore when the small size recording member $P_1$ is passed in succession between the fixing roller 1 and the pressure roller 2, excessive temperature rise in the non-paper passing region Z2 on the fixing roller 1 is prevented so that the quality of the entire surface of the large size recording member $P_2$ can be uniformed when the large size recording member $P_2$ is passed as well as denaturalization and deterioration of the fixing roller 1 by heat are prevented.

Moreover, since the fixing roller 1 has the sponge layer 12, the sponge layer 12 can decrease the thermal capacity of the fixing roller 1 as an insulating material and can increase the width size of the nip section N formed by the mutual contact between the fixing roller 1 and the pressure roller 2 as an elastic material. This allows high-speed driving of the fixing device.

Moreover, since the pressure roller 2 has the sponge layer 22, the sponge layer 22 can decrease the thermal capacity of the pressure roller 2 as an insulating material and can increase the width size of the nip section N formed by the mutual contact between the fixing roller 1 and the pressure roller 2 as an elastic material. This allows high-speed driving of the fixing device.

Moreover, the magnetic flux generating section 3 is placed outside the fixing roller 1, which facilitates placement of the magnetic flux generating section 3 and makes the fixing roller 1 having the sponge layer 12 appropriately generate heat.

Moreover, the control section 5 operates the motor 7, the magnetic flux generating section 3 and the heater 42 during the standby time at which transportation of the recording member P is not requested, and this makes it possible to keep the pressure roller 2 at a specified temperature during the standby time so as to reduce time taken for the fixing device to recover from the standby state. Moreover, the control section 5 operates the motor 7 and the magnetic flux generating section 3 but does not operate the heater 42 during the paper passing time at which transportation of the recording member P is requested, and therefore high-temperature heat in a non-paper passing area in the fixing roller 1 moves to a low-temperature paper passing area in the fixing roller 1 through the pressure roller 2 and the unheated heater 42, which makes it possible to achieve an effect of preventing or alleviating temperature rise in the non-paper passing area.

Moreover, the control section 5 controls the magnetic flux generating section 3 and the heater 42 based on outputs from the first temperature detection section 6 and the second temperature detection section 8 so that the surface temperature of the fixing roller 1 and the surface temperature of the pressure roller 2 are each maintained to be specified temperatures during the standby time, which makes it possible to reliably reduce a time taken for the fixing device to recover from the standby state.

Moreover, the axial length of the heat conducting roller 41 is longer than the axial length of the pressure roller 2, so that the heat conducting roller 41 comes into contact with the entire axial region of the pressure roller 2. This makes it possible to reliably maintain the pressure roller 2 at a specified temperature during the standby time. Moreover, it becomes possible to reliably prevent temperature rise in the non-paper passing region Z2 in the fixing roller 1.

It is to be noted that the present invention is not limited to the embodiments disclosed. For example, although the fixing roller 1 includes the support layer 11, the sponge layer 12, the electromagnetic induction heat generating layer 13, the elastic layer 14 and the release layer 15, the fixing roller 1 may naturally include other layers in addition to these layers. This also applies to the pressure roller 2 as with the fixing roller 1.

As the fixing body, an endless fixing belt may be used instead of the fixing roller 1. As the pressing body, an endless pressure belt may be used instead of the pressure roller 2. The fixing roller 1 may be rotationally driven by the motor 7. The magnetic flux generating section 3 may be placed inside the fixing roller 1. As the heating body 40, a long heater extending in the axial direction of the pressure roller 2 may be used. The load change body 50 may be mounted on the fixing roller 1. The heater 42 may be placed outside the heat conducting roller 41. As the heat conducting section, an endless belt or a fixed member which cannot rotate may be used instead of the heat conducting roller 41. As the first temperature detection section 6 and the second temperature detection section 8, contact-type thermistors may be used.

Embodiments of the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A fixing device, comprising:

a rotatable fixing body;

a rotatable pressing body for transporting a recording member together with the fixing body in a state of being in contact with the fixing body;

a drive section for rotationally driving the fixing body or the pressing body;

a magnetic flux generating section for generating a magnetic flux to make the fixing body generate heat;

a heating body placed outside the pressing body for heating the pressing body; and a control section for controlling the drive section to rotate the fixing body and the pressing body in a state that the fixing body and the pressing body are in contact with each other and controlling the heating body to heat the pressing body during a standby time at which transportation of the recording member is not requested and when the magnetic flux generating section is making the fixing body generate heat.

2. The fixing device according to claim 1, comprising a load change body for changing a load applied between the fixing body and the pressing body, wherein the control section controls the load change body so that the load applied between the fixing body and the pressing body during the standby time at which transportation of the recording member is not requested is smaller than the load during transportation of the recording member.

3. The fixing device according to claim 1, wherein the heating body has:

a heat conducting section for coming into contact with the pressing body and conducting heat to the fixing body through the pressing body so as to reduce temperature variations in axial direction of the fixing body; and a heating section for heating the heat conducting section.

4. The fixing device according to claim 1, wherein the fixing body has a sponge layer.

5. The fixing device according to claim 4, wherein the magnetic flux generating section is placed outside the fixing body.

6. The fixing device according to claim 1, wherein the pressing body has a sponge layer.

7. The fixing device according to claim 1, wherein when the recording member passes through between the fixing body and the pressing body, the control section brings the heating body into contact with the pressing body in a state that heating of the heating body is turned off.

8. A fixing device, comprising:

a rotatable fixing roller having a sponge layer, an electromagnetic induction heat generating layer and a release layer laminated in sequence around a support layer;

a pressure roller placed in contact with the fixing roller for transporting a recording member together with the fixing roller;

a drive section for rotationally driving the fixing roller or the pressure roller;

a magnetic flux generating section for generating a magnetic flux to make the fixing roller generate heat;

a heat conducting roller placed in contact with the pressure roller;

a heating section for heating the heat conducting roller; and a control section which operates the drive section, the magnetic flux generating section and the heating section during a standby time at which transportation of the recording member is not requested, and which operates the drive section and the magnetic flux generating section but does not operate the heating section during a paper passing time at which transportation of the recording member is requested.

9. The fixing device according to claim 8, comprising:

a first temperature detection section for detecting a surface temperature of the fixing roller; and a second temperature detection section for detecting a surface temperature of the pressure roller, wherein the control section controls the magnetic flux generating section and the heating section based on outputs from the first temperature detection section and the second temperature detection section so that the surface temperature of the fixing roller and the surface temperature of the pressure roller are each maintained to be specified temperatures during the standby time.

10. The fixing device according to claim 8, wherein the fixing roller has an elastic layer between the electromagnetic induction heat generating layer and the release layer.

11. The fixing device according to claim 8, wherein an axial length of the heat conducting roller is longer than an axial length of the pressure roller.

12. The fixing device according to claim 8, comprising a load change body for changing a load applied between the fixing roller and the pressure roller, wherein the control section controls the load change body so that the load applied between the fixing roller and the pressure roller during the standby time is smaller than the load during paper passing time.

* * * * *

UNITED STATES PATENT AND TRADEMARK OFFICE

CERTIFICATE OF CORRECTION

PATENT NO. : 7,496,311 B2
APPLICATION NO. : 11/444329
DATED : February 24, 2009
INVENTOR(S) : Yasuhiro Ohno et al.

It is certified that error appears in the above-identified patent and that said Letters Patent is hereby corrected as shown below:

Title Page, Item [75] (Inventors): change "Tomihiko" to --Tomohiko--.

Claim 7, Column 16, Line 12: delete "through" [should read: when the recording member passes between the . . .].

Signed and Sealed this

Second Day of June, 2009

JOHN DOLL
*Acting Director of the United States Patent and Trademark Office*